US012799676B2

(12) United States Patent
Ahlgren et al.

(10) Patent No.: US 12,799,676 B2
(45) Date of Patent: Nov. 17, 2026

(54) USE OF A CATIONIC COPOLYMER IN A MANUFACTURE OF PAPER, BOARD, TISSUE OR THE LIKE

(71) Applicant: KEMIRA OYJ, Helsinki (FI)

(72) Inventors: Jonni Ahlgren, Espoo (FI); Markus Korhonen, Espoo (FI)

(73) Assignee: KEMIRA OYJ, Helsinki (FI)

( * ) Notice: Subject to any disclaimer, the term of this patent is extended or adjusted under 35 U.S.C. 154(b) by 198 days.

(21) Appl. No.: 18/696,758

(22) PCT Filed: Sep. 28, 2022

(86) PCT No.: PCT/FI2022/050648

§ 371 (c)(1),
(2) Date: Mar. 28, 2024

(87) PCT Pub. No.: WO2023/052683

PCT Pub. Date: Apr. 6, 2023

(65) Prior Publication Data

US 2024/0384471 A1 Nov. 21, 2024

(30) Foreign Application Priority Data

Sep. 29, 2021 (FI) ..... 20216008

(51) Int. Cl.
*D21H 17/37* (2006.01)
*D21H 17/45* (2006.01)
*D21H 21/06* (2006.01)

(52) U.S. Cl.
CPC ..... *D21H 17/375* (2013.01); *D21H 17/455* (2013.01); *D21H 21/06* (2013.01)

(58) Field of Classification Search
CPC ..... D21H 17/375; D21H 17/455; D21H 21/06
See application file for complete search history.

(56) References Cited

U.S. PATENT DOCUMENTS 8,343,311 B2 * 1/2013 Hund ..... D21H 21/10 162/158
2013/0186584 A1 * 7/2013 Krapsch ..... D21H 17/28 162/161

(Continued)

FOREIGN PATENT DOCUMENTS

CN 109563686 A 4/2019
CN 109983177 A 7/2019

(Continued)

OTHER PUBLICATIONS

International Search Report and Written Opinion in Application No. PCT/FI2022/050648, mailed Dec. 21, 2022, 7 pages.

(Continued)

*Primary Examiner* — Abbas Rashid
*Assistant Examiner* — Stephen M Russell
(74) *Attorney, Agent, or Firm* — Meunier Carlin & Curfman LLC

(57) ABSTRACT

The invention relates to a use of a cationic copolymer obtained by polymerisation of (meth)acrylamide and cationic monomers, having a standard viscosity of ≥2 mPas and a charge density at most 5 meq/g, for reducing anionic substances and/or 5 anionic particulate material in an aqueous phase of a thick fibre stock having a consistency of ≥20 g/l in a manufacture of a fibre web, such as paper, board, tissue or the like. The invention relates also to a method in a manufacture of a fibre web, such as paper, board, tissue or the like using such cationic copolymer.

13 Claims, 1 Drawing Sheet

(56) References Cited

U.S. PATENT DOCUMENTS

| | | | |
|---|---|---|---|
| 2019/0218717 | A1 | 7/2019 | Hietaniemi et al. |
| 2021/0002827 | A1 | 1/2021 | Luo et al. |

FOREIGN PATENT DOCUMENTS

| | | | |
|---|---|---|---|
| JP | 2004244766 | A | 9/2004 |
| JP | 2006214028 | A | 8/2006 |
| JP | 2019060045 | A | 4/2019 |
| WO | 2008/095769 | A1 | 8/2008 |
| WO | 2013/001169 | A1 | 1/2013 |
| WO | 2018109279 | A1 | 6/2018 |
| WO | 2018229345 | A1 | 12/2018 |
| WO | 2019239819 | A1 | 12/2019 |
| WO | 2021/001602 | A1 | 1/2021 |

OTHER PUBLICATIONS

Finnish Search Report in Application No. 20216008, dated Apr. 21, 2022, 2 pages.
Search Report issued by the Chinese Application No. 202280066061.0, mailed Jan. 7, 2026.

* cited by examiner

USE OF A CATIONIC COPOLYMER IN A MANUFACTURE OF PAPER, BOARD, TISSUE OR THE LIKE

CROSS REFERENCES

This application is a U.S. National Stage application of the international application number PCT/FI2022/050648 filed on Sep. 28, 2022 and claiming priority to Finnish national application Ser. No. 20/216,008 filed on Sep. 29, 2021.

FIELD OF INVENTION

The present invention relates to a use of a cationic copolymer obtained by polymerisation of (meth)acrylamide and cationic monomer(s) in a manufacture of paper, board, tissue or the like according to the preambles of the enclosed independent claims.

BACKGROUND

Anionic particulate material and anionic substances, such as anionic hydrophobic colloids are known to form deposits on process surfaces in manufacture on paper, board, tissue or the like. The formed deposits may cause web breakages, so the most affected surfaces, such as drying cylinders, calenders, wires and felts, are being regularly washed and cleaned as a precautionary measure. This leads to downtime and loss of production. Even when not causing web breakage, the formed deposits may reduce the quality of the produced fibre web. The reduced quality may be seen as holes and/or dark spots in the final fibre web, even to such extent that the produced web is not suitable for the intended end-use but must be rejected.

Conventionally the problems caused by anionic particulate matter and anionic substances are alleviated by addition of one or more fixative agents into the fibrous stock before it is formed into a fibrous web. Fixative agents are usually synthetic cationic polymers. Cationic polymers react with anionic hydrophobic colloids and anionic particulate material in a manner of polyelectrolyte complexation. Cationic polymers can form agglomerates with dissolved and colloidal substances and attach them onto fibres, fillers and fines in the paper stock. This phenomenon is generally called fixation.

Synthetic cationic polymers, which are used as fixatives, are usually polymers with low molecular weight and high cationic charge density, such as copolymers of dialkylamines and epichlorohydrin, poly-diallyldimethylammonium chloride (p-DADMAC), poly-ethyleneimine and polyvinylamine. Even low molecular weight cationic polyacrylamide with high charge density may be used. The molecular weight of these synthetic cationic polymers may be from about ten thousand daltons to few hundreds of thousands of daltons. The low molecular weight polymers used as fixatives are usually added in relatively large amounts for obtaining effective results. This may lead to increased chemical costs. Furthermore, addition of large amounts of synthetic polymers may not be advantageous in view of the overall process sustainability.

Consequently, there is a continuous need for new effective fixative agents in the manufacture of fibrous webs, such as paper, board, tissue or the like.

SUMMARY

An object of this invention is to minimise or possibly even eliminate the disadvantages existing in the prior art.

Another object of the present invention is to provide an effective control of anionic particulate matter and anionic substances causing deposits in the manufacture of paper, board, tissue or the like.

A further object of the present invention is especially to improve the fixation of the anionic particular material and/or anionic substances onto the fibres in the manufacture of paper, board, tissue or the like and reduce their amount in the aqueous phase of the fibre stock.

These objects are attained with the invention having the characteristics presented below in the characterising parts of the independent claims. Some preferred embodiments of the invention are presented in the dependent claims.

The features recited in the dependent claims as well as the embodiments in the description are mutually freely combinable unless otherwise explicitly stated.

The exemplary embodiments presented in this text and their advantages relate by applicable parts to the use and the method according to the invention, even though this is not always separately mentioned.

A typical use according to the present invention of a cationic copolymer obtained by polymerisation of (meth) acrylamide and cationic monomers, having a standard viscosity of ≥2 mPas and a charge density at most 5 meq/g, is for reducing anionic substances and/or anionic particulate material in an aqueous phase of a thick fibre stock having a consistency of ≥20 g/l in a manufacture of a fibre web, such as paper, board, tissue or the like.

A typical method according to the invention for reducing anionic substances and/or anionic particulate material in an aqueous phase of a fibre stock in a manufacture of a fibre web, such as paper, board, tissue or the like, comprises:

- providing an aqueous thick fibre stock a having consistency of ≥20 g/l;
- adding a cationic copolymer obtained by polymerisation of (meth)acrylamide and cationic monomers, having a standard viscosity of ≥2 mPas and a charge density at most 5 meq/g to the aqueous thick fibre stock,
- optionally diluting the fibre stock,
- forming the fibre stock into a fibre web and drying the web.

Now it has been surprisingly found that cationic copolymers obtained by polymerisation of (meth)acrylamide and cationic monomers, which have a standard viscosity of ≥2 mPas and a charge density at most 5 meq/g, are unexpectedly effective in attaching anionic substances and/or anionic particulate material to a fibre web. Contrary to the expectations, the specific copolymers of the present invention reduce the amount of anionic particulate material and anionic substances in the aqueous phase of the thick fibre stock, and this is observed as the significantly reduced turbidity of the aqueous phase. It is assumed that high molecular weight of the cationic copolymers, indicated by their standard viscosity, enables the copolymers effectively to interact with the anionic particulate material as well as anionic substances present in the aqueous phase of the thick fibre stock. The effective interaction might enable to reduce the total amount of used copolymer, which improves the sustainability of the manufacturing process of the fibre web. Furthermore, the cationic copolymer which is used in the present invention has relatively low cationicity. This means that the risk of overcationisation of the process is reduced and the runnability of the process is improved. For example, the risk of unnecessary foam build-up due to overcationization may be avoided.

DETAILED DESCRIPTION

Figure 1:
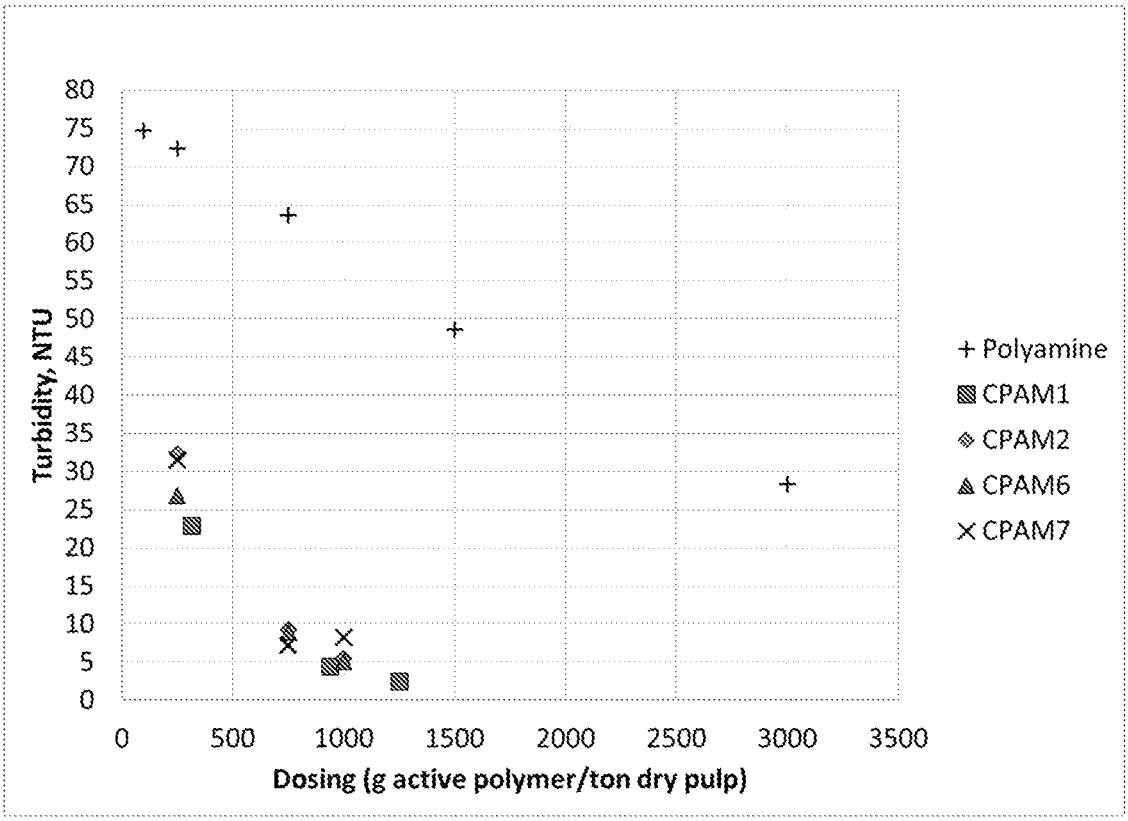
FIG. 1 illustrated the results of the fixing tests of Example 1.

In the present context the term "anionic substances and/or anionic particulate material" comprises usually anionic colloids and anionic hydrophobic substances such as anionic trash; stickies, including microstickies and macrostickies; anionic hydrophobic colloidal substances, anionic hydrophobic agglomerates; pitch; and the like. Stickies include synthetic anionic hydrophobic substances or particulate material originating e.g. from adhesives; printing inks; coating binders, such as latex; waxes used in cartons for packaging; and hydrophobic internal and surface sizing agents. Pitch includes natural anionic hydrophobic substances, such as wood extractives, sterols, fatty acids, resin acids, fatty esters, including their salts and other forms thereof. Anionic colloids comprise anionic solid particles, such as synthetic polymer particles, having a particle size in a range of 1-200 nm, preferably 1-100 nm. The anionic substances and/or anionic particulate material may have a widely variable particle size. The present invention is especially efficient in fixing anionic substances and/or anionic particulate material having particle size of 0.1-150 μm, preferably 1-150 μm, such as 3-100 μm, especially by fixing them onto the fibres.

According to one embodiment of the invention the cationic copolymer of (meth)acrylamide and cationic monomer (s) may be preferably used for fixing and for reducing the amount of the anionic substances and/or anionic particulate material selected from anionic colloidal pitch particles and/or latex binder particles. It has been observed that when cationic copolymer is used according to the present invention, the fixation results are especially improved when the fibre stock contains anionic colloidal pitch particles and/or latex binders and their amount is effectively reduced in the aqueous phase of a fibre stock.

The cationic copolymer is preferably used alone, as sole agent for reducing the amount of the anionic substances and/or anionic particulate material in the thick fibre stock. No anionic additive agents are necessary, which makes the use of the cationic copolymer simple.

The cationic copolymer may be suitably used for fibre stock comprising cellulosic fibres obtained by chemical pulping, mechanical pulping, recycled cellulosic fibres and/or broke. The cationic copolymer is especially suitable for fibre stock comprising or consisting of recycled cellulosic fibres and/or cellulosic fibres obtained by mechanical pulping.

According to one embodiment of the invention the charge density of the fibre stock is negative before and after the addition of the cationic copolymer to the fibre stock.

Preferably the thick fibre stock does not contain significant amount of inorganic filler particles, such as calcium carbonate or talc particles. The amount of inorganic filler particles may be ≤10 weight-%, preferably ≤5 weight-%, more preferably ≤2 weight-%, calculated from the dry weight of the fibre stock. The amount of the inorganic particles may be, for example, in a range of 0-10 weight-%, preferably 0.1-5 weight-%, more preferably 0.5-2 weight-%.

In the present context the terms "fixation", "fixing" and "fix" means that the anionic substances and/or anionic particulate material are quantitatively reduced in the aqueous phase. They may be removed from the aqueous phase of the fibre stock and associated or attached onto the fibres and possibly filler particles at least temporarily or permanently.

The cationic copolymer of (meth)acrylamide and cationic monomers which is used in the present invention has the standard viscosity of ≥2 mPas. According to one preferable embodiment the cationic copolymer may have the standard viscosity of ≥2.2 mPas, preferably ≥2.5 mPas, more preferably ≥3.5 mPas. For example, the cationic copolymer may have the standard viscosity in a range of 2-7 mPas, preferably 2.2-6 mPas, more preferably 2.3-5 mPas, even more preferably 2.5-4.5 mPas, sometimes even more preferably 3-4 mPas. The standard viscosity of the copolymer correlates directly to its molecular weight. The higher the standard viscosity, the longer are the chains of the copolymer. It has been surprisingly observed that the long copolymer chain can effectively compensate the low cationicity of the copolymer and provide good fixation results.

Standard viscosity is measured at 0.1 weight-% polymer content in an aqueous 1 M NaCl solution, using Brookfield LV viscometer equipped with UL adapter, at 25° C., using UL Adapter Spindle and rotational speed 60 rpm. A general relationship between the standard viscosity of the copolymer and its average molecular weight is given in Table 1.

TABLE 1

Relationship between the standard viscosity and the average molecular weight.

| Standard viscosity [mPas] | Average molecular weight [$10^6$ g/mol] |
|---|---|
| 2 | 1.3 |
| 2.5 | 3.4 |
| 3 | 5.5 |
| 3.5 | 7.6 |
| 4 | 9.8 |
| 4.5 | 11.9 |
| 5 | 14.0 |
| 5.5 | 16.1 |
| 6 | 18.3 |
| 6.5 | 20.4 |
| 7 | 22.5 |

The relationship shown in Table 1 is based on standard viscosity and intrinsic viscosity measurements and using Mark-Houwink-Sakurada constants $K=2.57\cdot10^{-4}$ dl/g and a=0.67.

The cationic copolymer of (meth)acrylamide and cationic monomers which is used in the present invention has the charge density at most 5 meq/g. According to one preferable embodiment the cationic copolymer may have the charge density at most 4 meq/g, preferably at most 3 meq/g. The charge density may be, for example in a range of 0.5-5 meq/g, preferably 1-4 meq/g, more preferably 1-3 meq/g, even more preferably 2-3 meq/g. The relatively low cationicity of the cationic copolymer does not only provide economic advantages as the amount of expensive cationic monomers can be minimised in the copolymer production, but also the risks relating to overcationisation of the fibre web manufacture and the associated runnability problems can be reduced.

The cationic copolymer of (meth)acrylamide and cationic monomers may be obtained by polymerisation of (meth) acrylamide and at most 95 mol-%, preferably at most 90 mol-%, more preferably at most 55 mol-%, even more preferably at most 50 mol-%, of cationic monomers. According to one preferable embodiment the cationic copolymer is obtained by polymerisation of (meth)acrylamide and 4-95 mol-%, preferably 5-90 mol-%, more preferably 5-55 mol-%, even more preferably 8-50 mol-% or 10-50 mol-%, of cationic monomers. For example, preferably the cationic copolymer is obtained by polymerisation of (meth) acrylamide and 19-50 mol-%, preferably 19-40 mol-%, more preferably 15-35 mol-% or 19-33 mol-%, of cationic monomers.

Preferably, the cationic copolymer is free of anionically charged structural units. This means that the total ionicity of the cationic copolymer corresponds to the amount of cationic monomers used.

The cationic monomer may be selected from diallyldimethylammonium chloride (DADMAC), 2-(dimethylamino) ethylacrylate (ADAM), [2-(acryloyloxy)ethyl] trimethylammonium chloride (ADAM-Cl), 2-(dimethylamino)ethyl acrylate benzylchloride, 2-(dimethylamino)ethyl acrylate dimethylsulphate, 2-dimethylaminoethyl methacrylate (MADAM), [2-(methacryloyloxy)ethyl] trimethylammonium chloride (MADAM-Cl), 2-dimethylaminoethyl methacrylate dimethylsulphate, [3-(acrylamido)propyl] trimethylammonium chloride (APTAC) and [3-(methacrylamido) propyl] trimethylammonium chloride (MAPTAC). According to one preferable embodiment the cationic monomer is [2-(acryloyloxy)ethyl] trimethylammonium chloride (ADAM-Cl).

According to one preferable embodiment the cationic copolymer is a linear polymer. In other words, the cationic copolymer is unbranched and preferably not crosslinked. In the polymerisation the amount of cross-linker is less than 0.002 mol-%, preferably less than 0.0005 mol-%, more preferably less than 0.0001 mol-%. According to one embodiment the polymerisation is completely free of cross-linker. The linear copolymer effectively reduces the risk of formation of insoluble polymer particles, which could reduce the quality of the produced paper or board.

The cationic copolymer of (meth)acrylamide and cationic monomers is water-soluble and it may be obtained by free radical polymerisation of (meth)acrylamide and cationic monomer(s). The term "water-soluble" denotes here that the copolymer is fully miscible with water. When mixed with excess of water, the obtained copolymer solution is preferably essentially free from discrete polymer particles or granules. Excess of water means that the obtained polymer solution is not a saturated solution.

The cationic copolymer may be obtained, for example, by solution polymerisation, suspension polymerisation, inverse emulsion polymerisation, gel polymerisation or by dispersion polymerisation. According to one preferable embodiment the cationic copolymer is obtained by gel polymerisation which produces a copolymer, which is in gel form or highly viscous liquid. After the gel polymerisation, the obtained copolymer in gel form is comminuted, such as shredded or chopped, as well as dried and optionally milled, whereby a dry particulate copolymer is obtained.

The cationic copolymer of (meth)acrylamide and cationic monomers is usually dissolved and/or diluted into water before its use in manufacture of paper, board, tissue or the like. The cationic copolymer of (meth)acrylamide and cationic monomers is thus usually dissolved and/or diluted into water to form a diluted treatment solution before its addition to the fibre stock. The active polymer content of such diluted treatment solution may be 0.1-4 weight-%, preferably 0.3-3 weight-%, more preferably 0.5-2 weight-%. The diluted treatment solution may be further diluted before its introduction into the manufacturing process of paper, board, tissue of the like.

The cationic copolymer is added to the thick fibre stock in order to provide effective interaction with anionic substances and/or anionic particulate material in the aqueous phase. Thick fibre stock is here understood as a fibrous stock or furnish, which has a consistency of ≥20 g/l, preferably ≥25 g/l, more preferably ≥30 g/l. The thick fibre stock may have consistency of more than 20 g/l, preferably more than 25 g/l, more preferably more than 30 g/l. For example, the consistency of the thick fibre stock may be in a range of 20-70 g/l, preferably 25-65 g/l, more preferably 30-60 g/l. The cationic copolymer is preferably added to the thick fibre stock before the stock is diluted with water drained from the wire section of the manufacturing process. According to one embodiment the cationic copolymer may be used in amount of 50-2000 g/ton, preferably 100-1000 g/ton, more preferably 200-600 g/ton.

EXPERIMENTAL

Procedure for Fixing Test

Fixing test is conducted for examining the turbidity of a pulp sample as a function of the fixative chemical dosing. Hydrophobic colloidal particles are seen as turbidity in an aqueous phase of the pulp sample. When a cationic fixative chemical is added to the pulp sample, the fixative chemical fixes hydrophobic colloidal particles onto the fibre surfaces. This is seen as reduced turbidity of the aqueous phase of the pulp sample.

The pulp is first diluted to consistency about 10 g/l. The diluted pulp is warmed to a temperature of 45° C. To a sample (100 ml) of the warm diluted pulp a specified amount of the fixative chemical is added and the pulp sample is shaken vigorously in a tightly closed plastic can for 15 s by using two magnetic stirrers in the can as mixing aids. Then the pulp sample is gravity filtered by using black ribbon filter paper and the turbidity of the filtrate is measured using HACH, 2100 AN IS Laboratory Turbidimeter. It is assumed that the obtained results are fully applicable to stock with a higher consistency.

The lower the turbidity at certain fixative chemical dosing level, the better is the performance of the fixative chemical, i.e. the chemical is more effective in fixing the hydrophobic colloidal particle onto the fibre surface.

Used Polymers

A number of cationic polyacrylamides obtained by polymerisation of acrylamide and cationic monomers were tested for their fixative efficiency. Properties of the tested cationic polyacrylamides are given in Table 2.

TABLE 2

Properties of cationic polyacrylamides tested.

| Sample | Charge [mol-%] | Charge [meq/g] | SV* [mPas] |
|---|---|---|---|
| CPAM1 | 9 | 1.1 | 3.8 |
| CPAM2 | 9 | 1.1 | 3.0 |
| CPAM3 | 13 | 1.5 | 3.0 |
| CPAM4 | 18 | 1.9 | 3.0 |
| CPAM5 | 30 | 2.8 | 3.0 |
| CPAM6 | 6 | 0.8 | 3.8 |
| CPAM7 | 9 | 1.1 | 4.5 |

*Standard Viscosity, measured as defined in the description.

A commercial polyamine, commonly used as fixative chemical, was used as reference. The polyamine was used as 50% active solution and had a viscosity of 500-1000 mPas at 25° C., measured by Brookfield viscometer. The commercial polyamine has a low average molecular weight, which makes measurement of its standard viscosity difficult or pointless.

Example 1

The pulp was thermomechanical pulp (TMP) from a Finnish paper mill. Pulp was diluted to a consistency of 9.7 g/l. Pulp pH was 7.5. Fixing test was done as described above. Fixing test without any fixative chemical addition (0-test) gave turbidity value 73-76 NTU.

Tested polymers and obtained results of the fixing tests are given in Table 3 and shown in FIG. 1.

It can be seen from Table 3 and FIG. 1 that all tested polyacrylamides performed much better for fixing in thermomechanical pulp than the reference, i.e. polyamine which is commonly used as fixative chemical in manufacture of paper.

TABLE 3

Fixing test results of Example 1. Polymer dosages are given as active polymer per ton dry pulp.

| | Polymer | | | | |
|---|---|---|---|---|---|
| Dosage [g/t] | Polyamine Turbidity [NTU] | CPAM1 Turbidity [NTU] | CPAM2 Turbidity [NTU] | CPAM6 Turbidity [NTU] | CPAM7 Turbidity [NTU] |
| 100 | 75 | — | — | — | — |
| 250 | 72 | — | 32 | 27 | 32 |
| 312 | — | 23 | — | — | — |
| 750 | 64 | — | 9.3 | 8.9 | 7.2 |
| 937 | — | 4.5 | — | — | — |
| 1000 | — | — | 5.5 | 5.0 | 8.2 |
| 1250 | — | 2.5 | — | — | — |
| 1500 | 49 | — | — | — | — |
| 3000 | 28 | — | — | — | — |

Example 2

The pulp was groundwood pulp (GW) from a Finnish paper mill. Pulp was diluted to a consistency of 8.8 g/l. Fixing test was done as described above. Fixing test without any fixative chemical addition (0-test) gave turbidity value 63-75 NTU.

Figure 2:
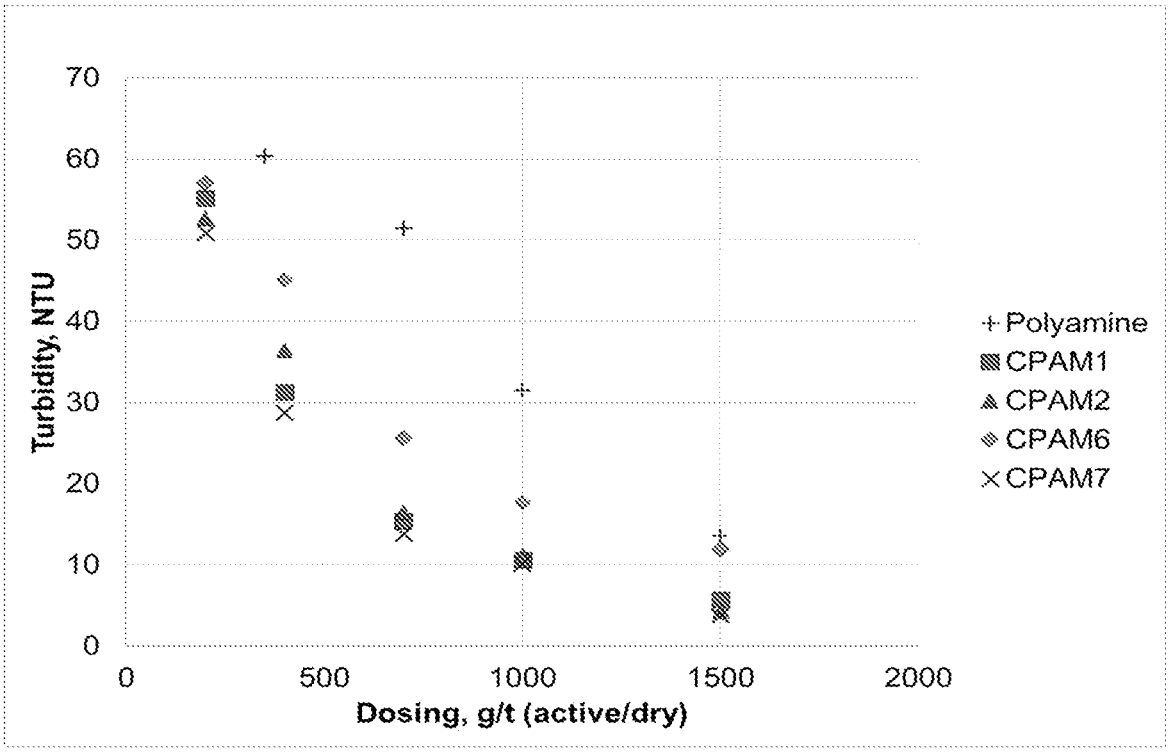
FIG. 2 illustrates the results of the fixing tests of Example 2.

Tested polymers and obtained results of the fixing tests are given in Table 4 and shown in FIG. 2.

TABLE 4

Used polymers and fixing test results of Example 2. Polymer dosages are given as active polymer per ton dry pulp.

| | Polymer | | | | |
|---|---|---|---|---|---|
| Dosage [g/t] | Polyamine Turbidity [NTU] | CPAM1 Turbidity [NTU] | CPAM2 Turbidity [NTU] | CPAM6 Turbidity [NTU] | CPAM7 Turbidity [NTU] |
| 200 | — | 55 | 53 | 57 | 51 |
| 350 | 60 | — | — | — | — |
| 400 | — | 31 | 36 | 45 | 29 |
| 700 | 52 | 15 | 17 | 26 | 14 |
| 1000 | 32 | 11 | 11 | 18 | 10 |
| 1500 | 14 | 5.7 | 4.3 | 12 | 3.7 |
| 2000 | 4.3 | — | — | — | — |

It is easily seen from Table 4 and FIG. 2 that all tested polyacrylamides performed much better for fixing in groundwood pulp than the reference, i.e. polyamine which is commonly used as fixative chemical in manufacture of paper.

Example 3

The pulp was groundwood pulp (GW) from a Finnish paper mill. Pulp was diluted to a consistency of 10 g/l. Fixing test was done as described above. In addition to turbidity, the charge of the filtrate and particle counts were measured. Particle counts, (all, hydrophobic agglomerates and colloids) were measured with Kemira Flyto™ which is based on flow cytometry (FCM), a widely used measurement technique which allows particles in a fluid sample to be analysed rapidly. Flow cytometry can be used to identify, measure and count all particles, hydrophobic agglomerates, small hydrophobic particles, and hydrophobic colloids (as a specific subset if present of all hydrophobic particles) in the size range from about 0.1 μm to 100 μm in process samples from pulp and paper manufacture, such as process waters, filtrates and pulp suspensions. Particle type differentiation is conducted by selective staining with fluorescent dyes. "All particles" value includes also hydrophobic particles and colloids. Hydrophobic agglomerates can include e.g. white pitch, stickies, fines and fillers contaminated with hydrophobic material. Stickies can also fall within the subpopulation of hydrophobic colloids. Therefore, colloids, small particles, fines, fillers and agglomerates are all analysed at the same time with the method.

Tested polymers and obtained results are given in Table 5.

It is seen from Table 5 that at addition levels of 150 g/t and 300 g/t all tested cationic copolymers were able to significantly decrease the negative charge and turbidity of the filtrate. The number of particles in the filtrate also decreased substantially. For example, fixing test conducted without any fixative chemical addition (0-test) gave turbidity of ca. 28 NTU and charge −23.0 μeq/l. Particle count for the 0-test was ca. 79 million, from which 3.25 million were hydrophobic agglomerates and 16 million hydrophobic colloids. Addition of CPAM5 at 300 g/t dosage reduced the number of hydrophobic agglomerates from 3.25 million in 0-test to less than half (1.59 million), and the amount of hydrophobic colloids from 16 million in 0-test to less than one tenth (ca. 1.29 million). All the obtained results indicate a very good fixing performance for cationic copolymers. In addition, it is seen that the increasing of the charge of the cationic copolymer, i.e. the amount of cationic monomers present in the polymerisation, the fixing efficiency can be increased significantly.

TABLE 5

Used polymers and fixing test results of Example 3. Polymer dosages are given as active polymer per metric ton dry pulp.

| Polymer | Dosage, g/t | Turbidity, NTU | Charge, meq/l | All particles, count | HP agglomerates, count | HP colloids, count |
|---|---|---|---|---|---|---|
| 0-test* | — | 28.1 | −23.0 | 79153000 | 3254000 | 16029000 |
| CPAM1 | 150 | 16.5 | −18.6 | 47071000 | 2609000 | 7965000 |
| CPAM1 | 300 | 8.33 | −18.9 | 43948000 | 2603000 | 5115000 |
| CPAM2 | 150 | 11.2 | −15.6 | 44575000 | 2833000 | 5600000 |
| CPAM2 | 300 | 7.1 | −16.4 | 35939000 | 2280000 | 3915000 |
| CPAM3 | 150 | 10.8 | −15.7 | 39577000 | 2726000 | 5798000 |
| CPAM3 | 300 | 7.22 | −17.3 | 31321000 | 1821000 | 3118000 |
| CPAM4 | 150 | 9.51 | −13.5 | 40204000 | 2213000 | 4012000 |
| CPAM4 | 300 | 5.48 | −16.8 | 31141000 | 1613000 | 2143000 |
| CPAM5 | 150 | 9.35 | −12.2 | 36664000 | 2276000 | 3658000 |
| CPAM5 | 300 | 3.2 | −12.5 | 23563000 | 1591000 | 1288000 |

*no polymer addition

It is apparent to a person skilled in the art that the invention is not limited exclusively to the examples described above, but that the invention can vary within the scope of the claims presented below.

The invention claimed is:

1. A method in a manufacture of a fibre web, the method comprising:

providing an aqueous thick fibre stock, having a consistency of ≥20 g/l;

adding to the thick fibre stock a non-crosslinked cationic copolymer to reduce anionic particular material selected from anionic colloidal pitch particles and latex binder particles in an aqueous phase of the thick fibre stock, wherein the non-crosslinked cationic polymer is obtained by polymerisation of (meth)acrylamide and cationic monomers, and the copolymer having a standard viscosity of from 2-4.5 mPas and a charge density of at most 5 meq/g;

optionally diluting the thick fibre stock; and forming the fibre stock into a fibre web and drying the web.

2. The method according to claim 1, wherein the cationic copolymer has the standard viscosity of ≥2.2 mPas.

3. The method according to claim 1, wherein the copolymer has the standard viscosity in a range of 2-7 mPas.

4. The method according to claim 1, wherein the copolymer has the charge density at most 4 meq/g.

5. The method according to claim 1, wherein the copolymer has the charge density in a range of 0.5-5 meq/g.

6. The method according to claim 1, wherein the cationic copolymer is obtained by polymerisation of (meth)acrylamide and at most 95 mol-% of cationic monomers.

7. The method according to claim 6, wherein the cationic copolymer is obtained by polymerisation of (meth)acrylamide and 4-95 mol-% of cationic monomers.

8. The method according to claim 1, wherein the cationic monomers are selected from diallyldimethylammonium chloride (DADMAC), 2-(dimethylamino)ethylacrylate (ADAM), [2-(acryloyloxy)ethyl] trimethylammonium chloride (ADAM-Cl), 2-(dimethylamino)ethyl acrylate benzylchloride, 2-(dimethylamino)ethyl acrylate dimethylsulphate, 2-dimethylaminoethyl methacrylate (MADAM), [2-(methacryloyloxy)ethyl] trimethylammonium chloride (MADAM-CI), 2-dimethylaminoethyl methacrylate dimethylsulphate, [3-(acrylamido) propyl] trimethylammonium chloride (APTAC) and [3-(methacrylamido) propyl] trimethylammonium chloride (MAPTAC).

9. The method according to claim 1, wherein the cationic copolymer is obtained by solution polymerisation, suspension polymerisation, inverse emulsion polymerisation, gel polymerisation or by dispersion polymerisation.

10. The method according to claim 1, wherein the fibre stock comprises cellulosic fibres obtained by chemical pulping, mechanical pulping and/or recycled cellulosic fibres.

11. The method according to claim 10, wherein the fibre stock comprises recycled cellulosic fibres and/or cellulosic fibres obtained by mechanical pulping.

12. The method according to claim 1, wherein the cationic copolymer is used in amount of 50-2000 g/ton.

13. The method according to claim 1, wherein the cationic copolymer is free of anionically charged structural units.

* * * * *